United States Patent [19]

Funabashi et al.

[11] 4,117,823

[45] Oct. 3, 1978

[54] AIR SUCKING DEVICE FOR ENGINES

[75] Inventors: Katsunori Funabashi; Mikihiro Kohyama, both of Kawagoe, Japan

[73] Assignee: Honda Giken Kogyo Kabushiki Kaisha, Tokyo, Japan

[21] Appl. No.: 746,238

[22] Filed: Dec. 1, 1976

[30] Foreign Application Priority Data

Dec. 13, 1975 [JP] Japan ..... 50/168602[U]

[51] Int. Cl.[2] ..... F02B 77/00

[52] U.S. Cl. ..... 123/198 E; 123/195 C; 181/204

[58] Field of Search ..... 123/198 E, 195 C, 73 A; 181/204

[56] References Cited

U.S. PATENT DOCUMENTS

| | | | |
|---|---|---|---|
| 3,036,566 | 5/1962 | Dobbertin | 123/198 E |
| 3,557,902 | 1/1971 | Brown | 123/198 E X |
| 3,612,022 | 10/1971 | Von Bomhard et al. | 123/198 E X |
| 3,924,597 | 12/1975 | Hatz et al. | 123/198 E |
| 3,949,726 | 4/1976 | List | 123/198 E |
| 3,951,114 | 4/1976 | Fachbach | 123/198 E X |
| 4,011,849 | 3/1977 | Latham | 123/198 E |

*Primary Examiner*—Charles J. Myhre
*Assistant Examiner*—Ira S. Lazarus
*Attorney, Agent, or Firm*—Irving M. Weiner

[57] ABSTRACT

An air sucking device for engines wherein the suction pipe, carburetor, and air cleaner are integrally connected together. The carburetor and suction pipe are housed within a covering so that the device affords protection and a favorable appearance for the respective components. The suction passageway is of a sufficient length to make operation of the engine more efficient.

8 Claims, 3 Drawing Figures

AIR SUCKING DEVICE FOR ENGINES

The present invention relates to improvements in air sucking devices, especially for two-cycle engines such as are used for engines of autobicycles or motocycles.

More particularly, the invention relates to an air sucking device wherein a suction pipe, a carburetor, and an air cleaner are integrally connected, and the carburetor, including the suction pipe, is covered with a cover so that the air sucking device is improved in protection and appearance. The invention is made simple, and positively fits the respective components to form a compact contour.

BACKGROUND OF THE INVENTION

In a conventional two-cycle engine used for motocycles or autobicycles, a suction pipe is so provided as to communicate with a crankcase and is connected with a carburetor through a tube made of rubber, and an air cleaner is connected with the carburetor so as to form an air sucking device. In such air sucking device, because the rubber tube is used for the connection, fastening bands are required and the tube is troublesome to fit and fasten. Particularly, in a small engine, the space is so small that the tube is difficult and inconvenient to fit, and fastening work and assembly is difficult. Further, there are disadvantages in that the vibrations caused by the engine and driving are transmitted to the connecting parts made of rubber to accelerate their fatigue and deterioration.

In such engine, a dead space will be formed on the upper surface or rear side of the crankcase and, if such space could be effectively utilized, it would be advantageous to small motor cars, motorcycles, or the like. On the other hand, even if an air sucking device is provided in such dead space as on the upper surface of the crankcase, a carburetor, which is complicated in contour and not so favorable in appearance, will be exposed and will not be preferable in appearance. In an autobicycle or motocycle, the engine and air sucking device would be exposed and would not be preferable in design. Further, if the carburetor, suction pipe, and connecting parts are exposed, they would not provide good protection. The present invention solves the foregoing problems.

SUMMARY OF THE INVENTION

The present invention provides an air sucking device for engines which includes an engine with a crankcase, and a suction pipe connected to and projecting from the crankcase of the engine. A carburetor is connected to a front end portion of the suction pipe. Also, an air cleaner case, in which an air cleaner is fitted, is connected to a front end portion of the carburetor. A cleaner cover is removably connected to a front end of the air cleaner case, and a covering member, which covers at least the upper surfaces of the carburetor and suction pipe, is connected at one end thereof with the air cleaner case and at the other end thereof with the crankcase side to cover the air cleaner case, carburetor, and suction pipe.

An object of the present invention is to provide an air sucking device for engines wherein a suction pipe is provided to rise and project from a crankcase, and is connected with an air cleaner at a distance through fitting members, such as bolts and stays. A carburetor is interposed between the air cleaner and suction pipe to connect such components, and the carburetor and suction pipe are covered with a cover.

Another object of the invention is to provide an air sucking device for engines which is simple in formation and fitting, and particularly requires no fastening means, such as fastening bands, and no fastening work. The invention saves labor, simplifies assembly, and improves the assembling workability of small engines to be used, for example, on small autobicycles or motocycles.

Another object of the present invention is to provide an air sucking device which can be positioned by utilizing dead space, such as on the upper surface of a crankcase of an engine. The invention is dimensionally compact in contour, improves the contour with a cover, improves appearance, and serves to protect the respective component parts.

A further object of the invention is to provide an air sucking device wherein, because the air cleaner is connected with a suction pipe through a carburetor held between them through stays or the like, the air cleaner can be formed to be free on one surface so that the cleaner element is easy to replace and the air cleaner is easy to maintain. The contour of the suction pipe is such that the suction passage may be set to be of a necessary and sufficient length, while the operation of the engine is made more efficient.

DETAILED DESCRIPTION OF PREFERRED EMBODIMENTS

Figure 1:
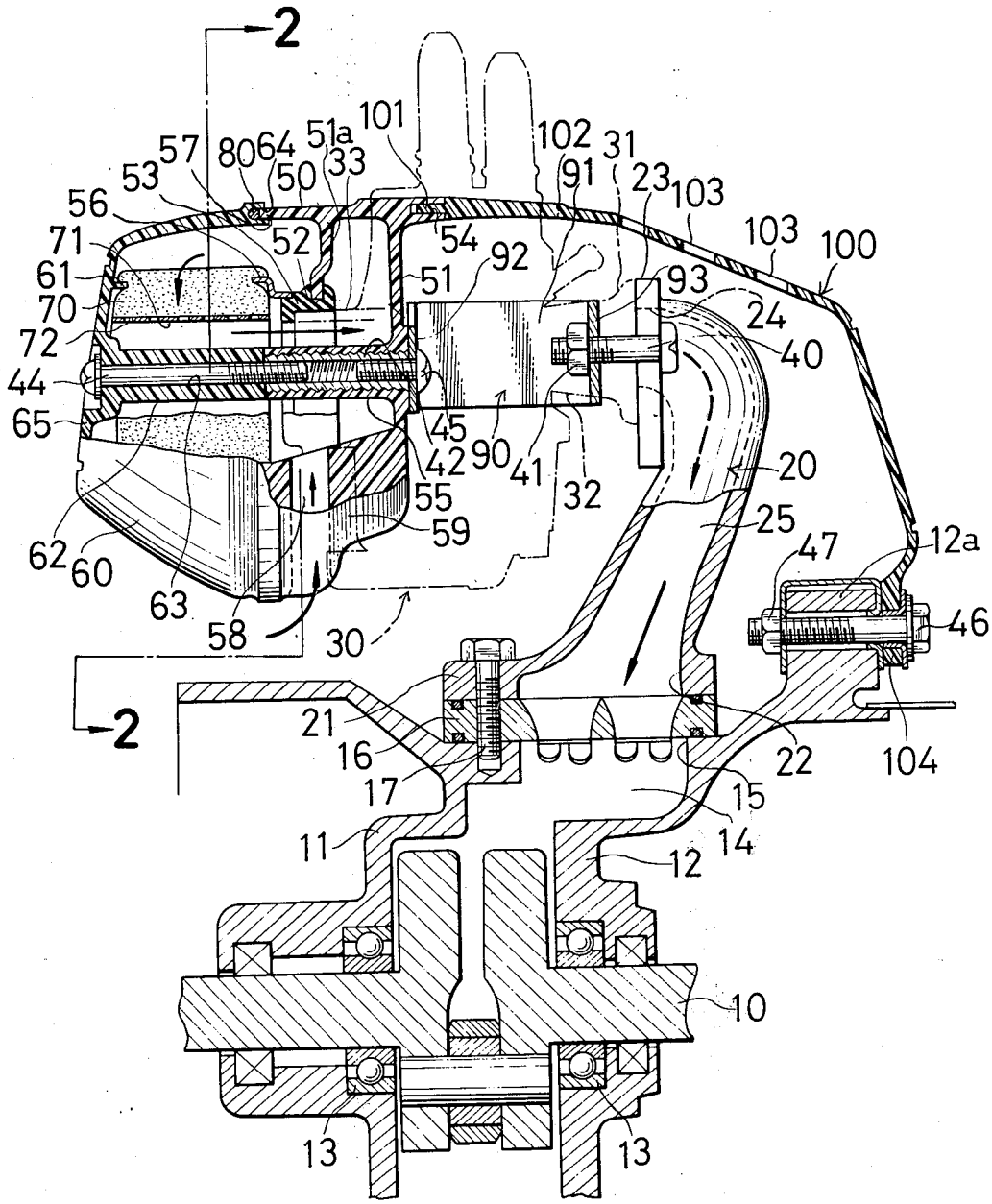
FIG. 1 is a side view sectioned in essential parts of an air sucking device according to the present invention.
Figure 2:
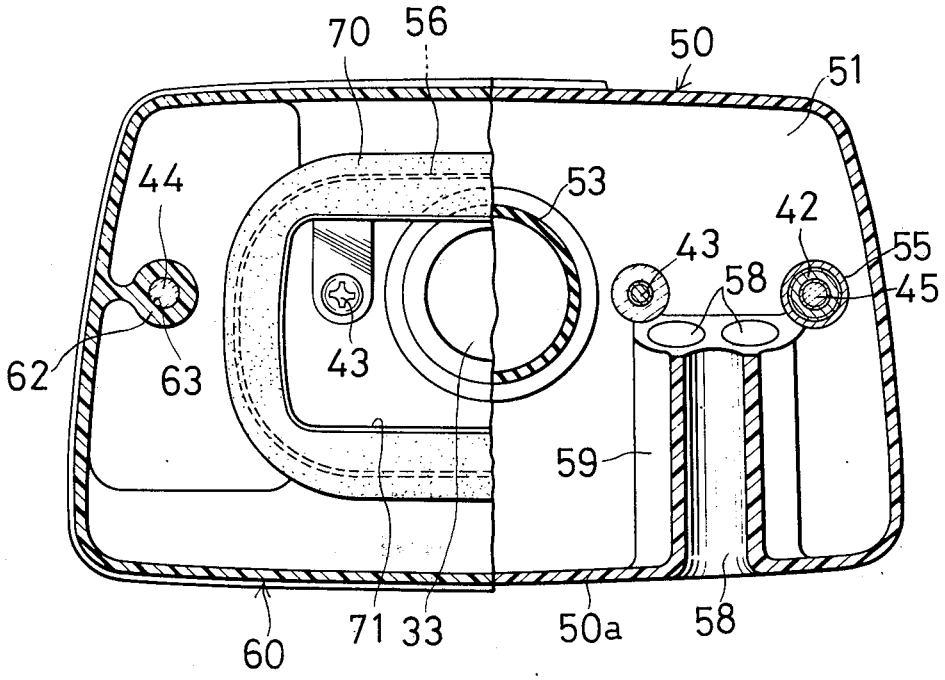
FIG. 2 is a sectioned view on line 2—2 in FIG. 1, one half being a sectioned view including an element part and the other half being a sectioned view including a suction inlet passage. p

FIG. 1 is a side view sectioned in essential parts of an air sucking device including a crankcase as seen from the front of the engine.

A crankshaft 10 is supported by left and right crankcases 11 and 12 through bearings 13. A suction inlet 15 is formed in a part of the upper surface of a crank chamber 14 between crankcases 11 and 12, and is connected with a suction pipe 20.

Suction pipe 20 is formed in a substantially inverted L-shaped contour, and is connected in a flange part 21 formed at its lower end with the end of inlet 15 through a lead valve 16 by a bolt 17. Pipe 20 is formed of the same metal material as that of the crankcases, is horizontal in its inlet part 24, and is bent in its rear portion to be suspended downwardly. Pipe 20 is connected with an outlet part 22 provided with flange 21, and has a suction passage 25 along the outlet 22 formed therewithin. A flange part 23 is provided in the end portion having inlet 24, and is joined with a flange part 31 formed on the end surface of an outlet part of a suction passage of a carburetor 30. Flange 23 is fastened with bolts 40 and nuts 41 to connect inlet 24 with an outlet part 32 of the carburetor. In FIG. 1, carburetor 30 is shown by phantom lines because, if it were shown by solid lines, it would unnecessarily complicate the drawing.

A suction inlet part 33 of carburetor 30 is fitted and connected in an opening 52 made in a forward expanded central part 51*a* of a rear wall 51 of an air cleaner case 50 through a connecting member 53, which is also a sealing member made, for example, of rubber. Cleaner case 50 is molded to be cup-shaped of plastic or the like, and has a groove 54 to fit an engaging part or flange 101 at the front end of a carburetor cover 100 disposed at the rear peripheral part of case 50. Cylindrical fitting parts 55 projecting inwardly (forwardly) are integrally formed on the right and left of wall 51 of case 50. A long nut 42 is integrally embedded within each fitting part 55, and is open in the front and rear on the end surface of fitting 55 and the rear surface of wall 51. A cleaner cover 60 is applied to the open front end of case 50.

Cover 60 is cup-shaped, has a cleaner element 70 positioned in its central portion, and is provided on its inner end surface with an engaging flange 61 to receive the front end surface of element 70 substantially laterally and rectangularly in its front section. Element 70 is pressed and connected at its rear end with the end edge of a supporting frame 56 provided laterally and rectangularly around an opening 52 of case 50, and fitted to wall 51 with screws 43. A shape-keeping frame 71 having many holes 72 is provided on the inner periphery of element 70 so that the space within frame 71 may enclose the periphery of member 53.

Cylindrical fitting parts 62, corresponding to parts 55 of case 50, are integrally provided to project on the right and left of the inner surface of cover 60, and are provided with respective holes 63 passing therethrough forwardly and rearwardly. A groove 64, fitting the open end 57 of case 50, is made at the open rear end of cover 60 so that both end 57 and groove 64 may be fitted and joined with each other by a sealing member 80. Screws 44 are inserted into respective holes 63 from the front wall 65 of cover 60 and are screwed at their tips respectively into the front parts of nuts 42 of case 50 to urge cover 60 toward case 50 and to connect case 50 and cover 60 with each other.

Suction inlet passages 58 opening on a bottom wall 50*a* are made within case 50. A plurality, or three in the illustration, of such passages 58 are made so as to vertically connect the interior of the chamber with the outside in an integrally molded block 59 provided to project on wall 50*a* of the case.

Air will be sucked into the space in the air cleaner, tightly enclosed within case 50 and cover 60, through the inlet ports 58 opening in the bottom of case 50, as indicated by the arrows. The air will be cleaned by air cleaner element 70, will be led into the interior of frame 71 through holes 72 on frame 71, and will be mixed with a fuel through inlet 33 of carburetor 30 opening in the interior of frame 71 to gasify the fuel. The gaseous mixture containing the gasified fuel will be introduced into chamber 14 in the crankcases through outlet 32, inlet 24 of pipe 20, passage 25, outlet 22, and lead valve 16. The arrows indicate the flow of air.

Figure 3:
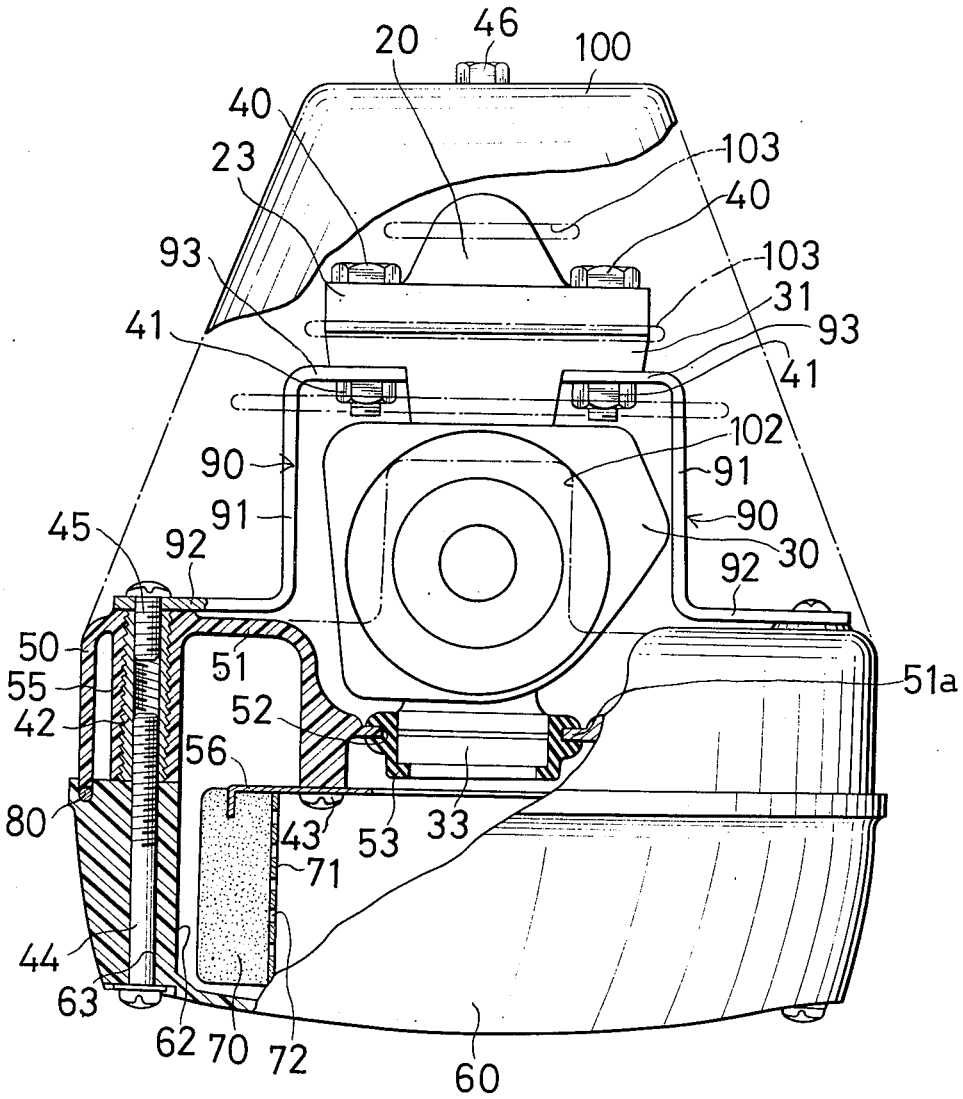
FIG. 3 is a plan view sectioned in essential parts with the cover removed.

As shown in FIG. 3, a pair of stays 90, shaped by bending plates to be substantially Z-shaped in the plan view, are joined at outward bent ends 92 at the right and left on the rear surface of rear wall 51 of case 50. Screws 45 are screwed with embedded nuts 42 to connect stays 90 with case 50. Bodies 91 of stays 90 pass by the side surfaces of carburetor 30, and have their other inwardly bent ends 93 in contact with the end surfaces of flange 31 to join it with flange 23 of pipe 20. Bolts 40 are inserted through bodies 91 which are fastened and connected with flanges 23 and 31 nuts 41.

Thus, the suction pipe 20 and case 50 hold the carburetor 30 between them so that components 20, 30 and 50 may be integrally connected together.

Flange 101, provided in the front end portion of carburetor cover 100, is fitted in groove 54 made at the rear end of case 50. Cover 100 is formed to be bent and suspended in its end part along and at a distance from the side of pipe 20 opposite carburetor 30. Cover 100 may be formed of plastic or the like. It has a window 102, through which the upper part of carburetor 30 projects upwardly, formed in the substantially horizontal front middle of cover 100. Cover 100 also has a plurality of ventilating holes 103 formed in its middle portion to radiate the heat of carburetor 30 and pipe 20 as shown in FIG. 3. The bent and suspended lower end part 104 of cover 100 is connected to a fitting member or bracket 12*a* projecting on crankcase 12 by a bolt 46 and nut 47.

Cover 100 preferably encloses both sides of carburetor 30 and the three sides of pipe 20 so that only the head of carburetor 30 may project, and a space sufficient to enclose the periphery including air cleaner cover 60 and case 50 may be provided below. Covers 60 and 100 and case 50 are molded of plastic so that the air sucking device may have only the head of the carburetor projected and may be covered on the periphery to obtain a favorably appearing design.

In assembling the air sucking device, the flange of carburetor 30 may be joined with flange 23 of pipe 20, and the bolts 40 may be inserted through them. Ends 93 of stays 90 are connected to case 50, and the inlet 33 of carburetor 30 is inserted into opening 52 of case 50. Nuts 41 are screwed to the tip parts of bolts 40 to assemble the components 20, 30 and 50. Cover 60 is made integral with case 50 in advance. Bolts 40 may be screwed from outside pipe 20, that is, from the right side in FIG. 1. Then cover 100 is fitted at the front end into groove 101 in case 50, and is connected in the lower end part 104 to bracket 12*a* by bolt 46 and nut 47.

Thus, the air sucking device can be simply assembled without using a rubber tube and fastening means. Further, because carburetor 30 and suction pipe 20 are covered with cover 100, the appearance will improve so much as to be very preferable in design when the device is used for motorcycles or autobicyles. The air sucking device is safely protected by cover 100 from stones and other objects which may hit it during driving. It is provided on the crankcase so as to be very preferable in utilization of dead space and the utilization of space in the layout of small motorcycles or autobicycles. Further, the suction inlet passage of the air cleaner is so made and the suction pipe is so bent that the total passage is increased, thereby increasing the efficiency of operation of the engine.

To replace the air cleaner element, the cover 60 is removed from case 50 by removing screws 44, and the element 70 is taken out. A new element 70 is set between cover 60 and case 50 and the screws 44 are threaded in again to complete the replacement. Therefore, the element can be replaced extremely simply.

We claim:

1. An air sucking device for engines, comprising, in combination:

an engine with a crankcase;

a suction pipe connected to and projecting from said crankcase of said engine;

a carburetor connected to a front end portion of said suction pipe;

an air cleaner case, in which an air cleaner is fitted, connected to a front end portion of said carburetor;

a cleaner cover removably connected to a front end of said air cleaner case;

a covering member, covering at least the upper surfaces of said carburetor and suction pipe, connected at one end thereof with said air cleaner case and at the other end thereof with the crankcase side to cover air cleaner case, carburetor, and suction pipe;

a groove made in the rear surface of said air cleaner case;

said covering member being engaged at its front end with said groove;

a fitting member (12*a*) being provided projecting from said crankcase; and said convering member (100) being connected in its lower end portion bent and suspended along said suction pipe to said fitting member (12*a*) projected on said crankcase.

2. An air sucking device according to claim 1, wherein:

said suction pipe opens at one end thereof in the outlet part of said carburetor and at the other end thereof in said crankcase;

said suction pipe is provided to rise from said crankcase; and said suction pipe is formed to be bent so that the suction passage may be longer than the height of said suction pipe.

3. An air sucking device according to claim 2, wherein:

the outlet part of said carburetor is joined to one end of said suction pipe;

a fitting member is secured at one end thereof to said air cleaner case and is joined at the other end thereof with the outside of the inlet part of said carburetor; and the foregoing components are integrally combined by means of screws.

4. An air sucking device according to claim 2, wherein:

said cleaner cover is screw-connected to said air cleaner case;

said air cleaner element is supported between said cleaner cover and air cleaner case; and said air cleaner element is replaceable by removing said cleaner cover from said air cleaner case.

5. An air sucking device according to claim 1, wherein:

the outlet part of said carburetor is joined to one end of said suction pipe;

a fitting member is secured at one end thereof to said air cleaner case and is joined at the other end thereof with the outside of the inlet part of said carburetor; and the foregoing components are integrally combined by means of screws.

6. An air sucking device according to claim 1, wherein:

said carburetor is screw-connected in its outlet part to one end of said suction pipe;

said carburetor is fitted and inserted with its inlet part in an opening provided in a wall of said air cleaner case; and stays, secured at one end thereof to a wall of said air cleaner case, are screw-connected at the other end thereof to one end of said suction pipe integrally with said outlet part of said carburetor.

7. An air sucking device according to claim 1, wherein:

said cleaner cover is screw-connected to said air cleaner case;

said air cleaner element is supported between said cleaner cover and air cleaner case; and said air cleaner element is replaceable by removing said cleaner cover from said air cleaner case.

8. An air sucking device according to claim 1, wherein:

said covering member is provided with ventilating holes, and is provided in the part corresponding to the head part of said carburetor with a window through which said head part projects upwardly.

* * * * *